US010475367B2

(12) United States Patent
Saito

(10) Patent No.: US 10,475,367 B2
(45) Date of Patent: Nov. 12, 2019

(54) DISPLAY DEVICE

(71) Applicant: Japan Display Inc., Tokyo (JP)

(72) Inventor: Keiichi Saito, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 16/117,206

(22) Filed: Aug. 30, 2018

(65) Prior Publication Data

US 2019/0073934 A1 Mar. 7, 2019

(30) Foreign Application Priority Data

Sep. 7, 2017 (JP) ..... 2017-171879

(51) Int. Cl.
*G09G 3/3258* (2016.01)
*G09G 3/3233* (2016.01)
(Continued)

(52) U.S. Cl.
CPC ..... *G09G 3/2003* (2013.01); *G09G 3/3233* (2013.01); *G09G 3/3258* (2013.01); *G09G 3/3291* (2013.01); *G09G 3/3266* (2013.01); *G09G 2300/0852* (2013.01); *G09G 2310/0251* (2013.01); *G09G 2310/0297* (2013.01);
(Continued)

(58) Field of Classification Search
CPC .. G09G 3/2003; G09G 3/3233; G09G 3/3291; G09G 3/3258; G09G 3/3266; G09G 3/3283; G09G 2320/0242; G09G 2320/0233; G09G 2320/0646; G09G 2330/023; G09G 2330/021; G09G 2360/16; G09G 2300/0852; G09G 2310/0251; G09G 2310/0297; G09G 2310/08
See application file for complete search history.

(56) References Cited

U.S. PATENT DOCUMENTS 6,380,943 B1 * 4/2002 Morita ..... G09G 3/2003 345/589
2008/0150880 A1 * 6/2008 Inuzuka ..... G09G 3/3413 345/102
(Continued)

FOREIGN PATENT DOCUMENTS

JP 2015-082074 A 4/2015
JP 2016-033607 A 3/2016

*Primary Examiner* — Jimmy H Nguyen
(74) *Attorney, Agent, or Firm* — K&L Gates LLP

(57) ABSTRACT

A display device includes an electroluminescent panel including first light-emitting elements to emit red (first color), second light-emitting elements to emit green (second color), and third light-emitting elements to emit blue (third color); an image analyzer that obtains, in displaying of a received video signal, first power serving as a total of power required for displaying red (first color), power required for displaying green (second color), and power required for displaying blue (third color), and that calculates second power by multiplying the first power by a predetermined coefficient according to the video signal, and calculates threshold power by multiplying, by the coefficient, maximum allowable power that is allowed when the electroluminescent panel performs image display; and a luminance adjuster that multiplies the video signal by a ratio between the threshold power and the second power when the second power is equal to or greater than the threshold power.

8 Claims, 10 Drawing Sheets

(51) Int. Cl.
*G09G 3/3291* (2016.01)
*G09G 3/3266* (2016.01)
*G09G 3/20* (2006.01)

(52) U.S. Cl.
CPC ..... *G09G 2320/0233* (2013.01); *G09G 2320/0242* (2013.01); *G09G 2330/023* (2013.01); *G09G 2360/16* (2013.01)

(56) References Cited

U.S. PATENT DOCUMENTS

| | | | | |
|---|---|---|---|---|
| 2014/0225933 | A1* | 8/2014 | Park ..... | G09G 5/10 345/690 |
| 2016/0035317 | A1 | 2/2016 | Imai et al. | |

* cited by examiner

FIG.10

D1

| VIDEO SIGNAL | COEFFICIENT |
|---|---|
| SINGLE-COLOR RASTER (R) | $\alpha 1$ (=1) |
| SINGLE-COLOR RASTER (G) | $\alpha 1$ (=1) |
| SINGLE-COLOR RASTER (B) | $\alpha 1$ (=1) |
| COMPLEMENTARY COLOR RASTER (Y) | $\alpha 2$ |
| COMPLEMENTARY COLOR RASTER (M) | $\alpha 2$ |
| COMPLEMENTARY COLOR RASTER (C) | $\alpha 2$ |
| WHITE RASTER (W) | $\alpha 3$ |
| NATURAL IMAGE (PATTERN 1) | $\alpha 4$-1 |
| NATURAL IMAGE (PATTERN 2) | $\alpha 4$-2 |
| NATURAL IMAGE (PATTERN 3) | $\alpha 4$-3 |
| : | : |
| NATURAL IMAGE (PATTERN p) | $\alpha 4$-p |

FIG.11

D2

| VIDEO SIGNAL | MAXIMUM POWER VALUE |
|---|---|
| SINGLE-COLOR RASTER (R) | Wrmax |
| SINGLE-COLOR RASTER (G) | Wgmax |
| SINGLE-COLOR RASTER (B) | Wbmax |

DISPLAY DEVICE

CROSS-REFERENCE TO RELATED APPLICATIONS

This application claims priority from Japanese Application No. 2017-171879, filed on Sep. 7, 2017, the contents of which are incorporated by reference herein in its entirety.

BACKGROUND

1. Technical Field

The present disclosure relates to a display device.

2. Description of the Related Art

Recent years have seen a growing demand for display devices each using a liquid crystal display panel or an organic electroluminescent display (OELD) panel that uses organic electroluminescence. For electronic apparatuses typified by portable information apparatuses, a need for technology to reduce power consumption is increasing. For example, since an electronic apparatus having a display device consumes large power for driving the display device, the power consumption required for driving the display device is desired to be reduced.

Organic electroluminescent (EL) elements constituting pixels of the OELD are self-luminous elements, and do not need an illuminating member, such as a backlight. Therefore, the power consumption can be reduced.

SUMMARY

A display device according to one aspect includes an electroluminescent (EL) panel comprising a plurality of first light-emitting elements configured to emit a first color, a plurality of second light-emitting elements configured to emit a second color, and a plurality of third light-emitting elements configured to emit a third color, an image analyzer configured to obtain, in displaying of a received video signal, a first power serving as a total value of a power required for displaying the first color, a power required for displaying the second color, and a power required for displaying the third color, and configured to calculate a second power by multiplying the first power by a predetermined coefficient according to the video signal, and calculate a threshold power by multiplying, by the coefficient, a maximum allowable power that is allowed when the EL panel performs image display, and a luminance adjuster configured to multiply the video signal by a ratio between the threshold power and the second power when the second power is equal to or greater than the threshold power.

BRIEF DESCRIPTION OF THE DRAWINGS

FIG. 10 is a diagram illustrating an example of coefficient information including coefficients for respective patterns of the video signal;

FIG. 11 is a diagram illustrating an example of maximum power value information including maximum power values for respective colors each required for displaying a single-color raster at the maximum gradation level.

DETAILED DESCRIPTION

Figure 1:
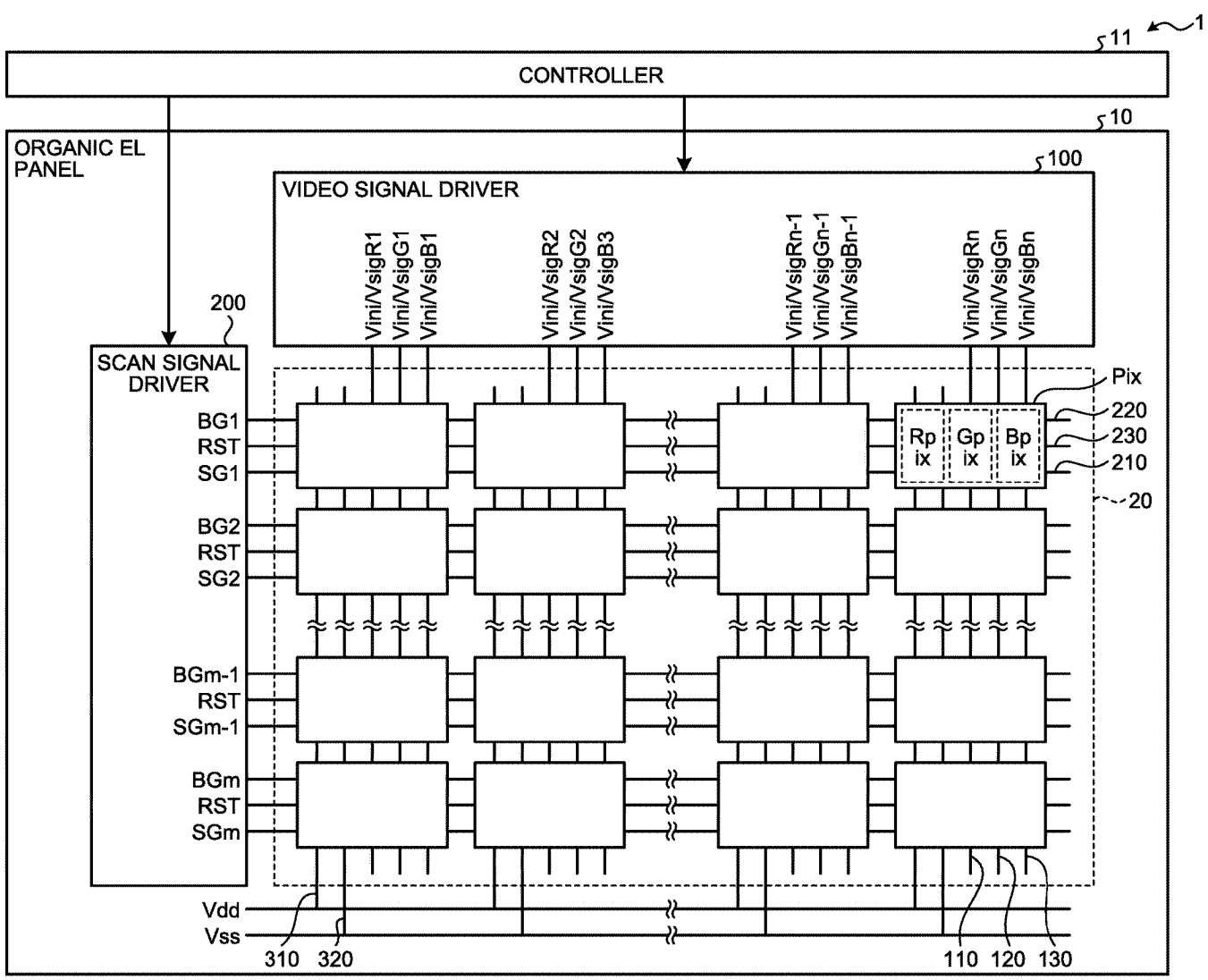
FIG. 1 is a block diagram illustrating a configuration example of a display device according to an embodiment of the present disclosure.

The following describes an embodiment of the present disclosure with reference to the drawings. The disclosure is merely an example, and the present disclosure naturally encompasses appropriate modifications easily conceivable by those skilled in the art while maintaining the gist of the disclosure. To further clarify the description, widths, thicknesses, shapes, and the like of various parts are schematically illustrated in the drawings as compared with actual aspects thereof, in some cases. However, they are merely examples, and interpretation of the present disclosure is not limited thereto. The same element as that illustrated in a drawing that has already been discussed is denoted by the same reference numeral throughout the description and the drawings, and detailed description thereof will not be repeated in some cases where appropriate. The power consumption, however, increases with increase in luminance of a display screen. Hence, for example, a function is provided in which a threshold is set for the total power consumption of all lines constituting one frame, and the luminance is automatically adjusted when the total power consumption is equal to or higher than the threshold (such as Japanese Patent Application Laid-open Publication No. 2016-033607 A). In the above-described technology, the luminance cannot be appropriately adjusted depending on the video signal, and power may exceed a maximum allowable power that is allowed when the display device displays an image. It is an object of the present disclosure to provide a display device capable of appropriately adjusting the luminance regardless of the video signal.

FIG. 1 is a block diagram illustrating a configuration example of a display device according to the embodiment. As illustrated in FIG. 1, a display device 1 according to the embodiment includes a controller 11 and an organic electroluminescent (EL) panel 10. Pixels Pix having thin-film transistors (TFTs) and organic electroluminescent (EL) elements are arranged in a matrix in a display region 20 of the organic EL panel 10. Other electroluminescent (EL) elements, such as μ(micro) LED and so on, can be applied in replace of organic electroluminescent (EL) elements. In the display region 20, a row denotes an array in the horizontal direction, and a column denotes an array in the vertical direction. FIG. 1 illustrates an example in which m (where m is a natural number) pixels Pix are arranged in the row direction, and n (where n is a natural number) pixels Pix are arranged in the column direction.

In the present embodiment, each of the pixels Pix includes three sub-pixels Rpix, Gpix, and Bpix. The three sub-pixels Rpix, Gpix, and Bpix included in the pixel Pix have luminescent colors of, for example, red (R), green (G), and blue (B), respectively, and serve as the pixel Pix as one-unit pixel constituted by three sub-pixels. Light-emitting elements (organic EL elements) constitute the sub-pixels Rpix, Gpix, and Bpix. In the present embodiment, the light-emitting elements are organic light-emitting diodes. The organic EL panel 10 uses a video signal driver 100 and a scan signal driver 200 to generate signals for controlling light emission of the light-emitting elements, and thus displays an image.

The controller 11 controls the video signal driver 100 and the scan signal driver 200 based on a video signal supplied from, for example, an external host integrated circuit (IC) (not illustrated). The controller 11 is included in, for example, an integrated circuit (IC), and supplies control signals to the video signal driver 100 and the scan signal driver 200 to control them so as to operate in synchronization with each other.

The controller 11 includes a clock generator (not illustrated) for generating a reference clock. The controller 11 is configured to generate the control signals to be supplied to the video signal driver 100 and the scan signal driver 200 based on the reference clock generated by the clock generator.

The video signal driver 100 is an IC that generates video voltages to be applied to each of the pixels Pix. The scan signal driver 200 is an IC that generates gate voltages to be applied to the thin-film transistor (TFT) elements. The TFT elements are included in each of the pixels Pix for selecting pixels to be applied with the video voltages. The video signal driver 100 and the scan signal driver 200 are illustrated in FIG. 1 as components different from each other, but may be incorporated in one IC, or may be constituted by a circuit directly provided on a substrate.

The video signal driver 100 is coupled to video signal lines 110, 120, and 130 traversing in the column direction in the display region 20. The video signal lines 110 are common to corresponding ones of the sub-pixels Rpix arranged in the column direction. The video signal lines 120 are common to corresponding ones of the sub-pixels Gpix arranged in the column direction. The video signal lines 130 are common to corresponding ones of the sub-pixels Bpix arranged in the column direction. The video signal lines 110, 120, and 130 are coupled to pixel switches included in the sub-pixels Rpix, Gpix, and Bpix, respectively. An equivalent circuit of the pixel Pix including the pixel switches will be described in detail with reference to the diagrams below.

The scan signal driver 200 is coupled to scan signal lines 210, light emission control lines 220, and power supply lines 230 traversing in the row direction in the display region 20. Each of the scan signal lines 210, each of the light emission control lines 220, and each of the power supply lines 230 are common to corresponding ones of the pixels Pix arranged in the row direction.

The organic EL panel 10 includes high-potential supply lines 310 (first reference voltage) and low-potential supply lines 320 (second reference voltage). The potential of the high-potential supply lines 310 is denoted as a high-potential voltage Vdd. The potential of the low-potential supply lines 320 is denoted as a low-potential voltage Vss. The high-potential supply lines 310 and the low-potential supply lines 320 are common to all the pixels Pix constituting the display region 20 or some of the pixels Pix. The high-potential supply lines 310 and the low-potential supply lines 320 give potential differences for causing the light-emitting elements in the sub-pixels Rpix, Gpix, and Bpix of the respective pixels Pix to emit light.

Figure 2:
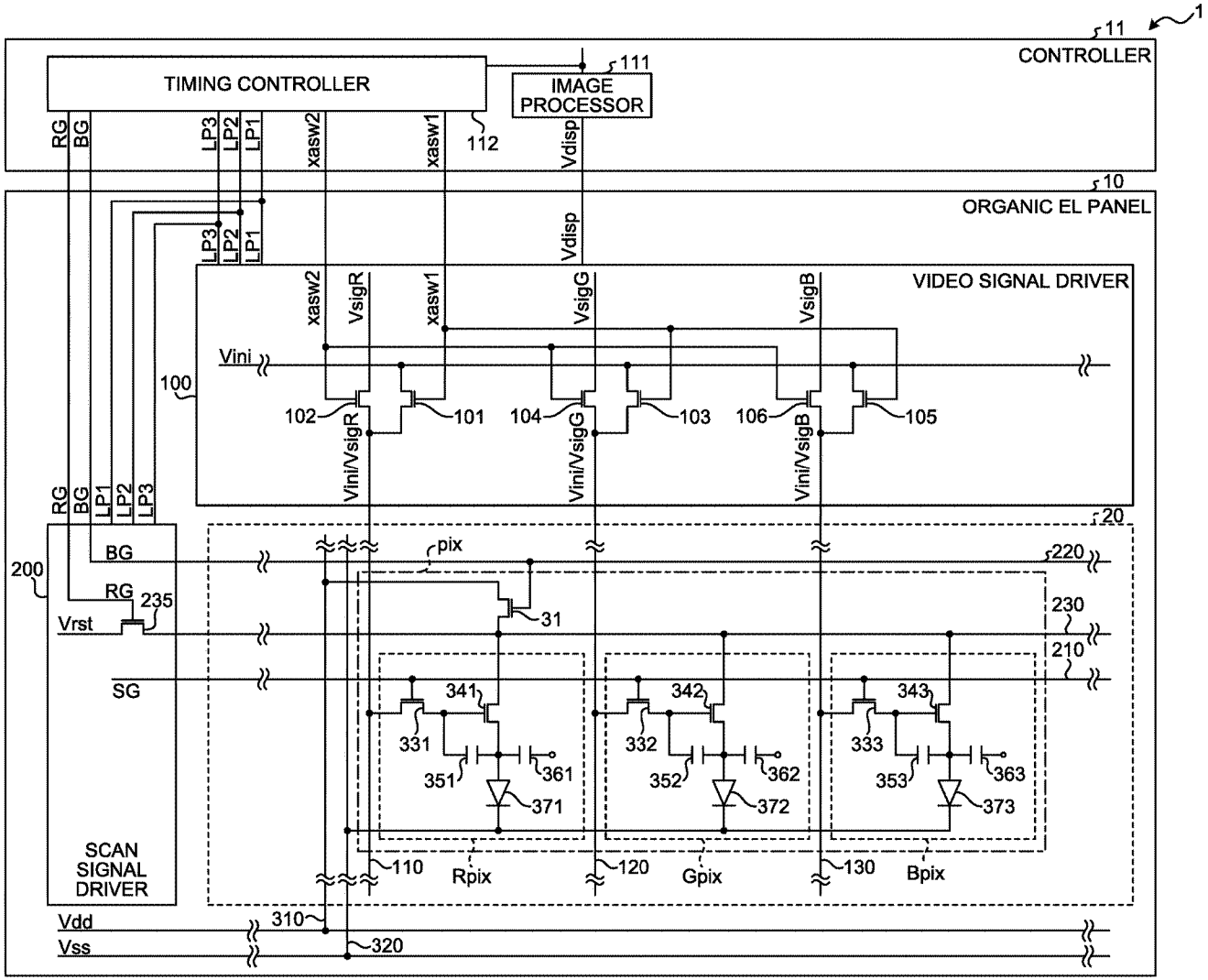
FIG. 2 is a diagram illustrating an exemplary configuration of elements including an equivalent circuit of a pixel of an organic electroluminescent (EL) panel for the display device according to the embodiment.

FIG. 2 is a diagram illustrating an exemplary configuration of elements including the equivalent circuit of a pixel of the organic EL panel for the display device according to the embodiment. FIG. 2 illustrates the exemplary configuration of one of the pixels Pix constituting the display region 20.

As described above, in the present embodiment, the pixel Pix includes the three sub-pixels Rpix, Gpix, and Bpix. The three sub-pixels Rpix, Gpix, and Bpix correspond to the luminescent colors of, for example, red (R), green (G), and blue (B). The three sub-pixels Rpix, Gpix, and Bpix share a light emission control switch 31.

The controller 11 includes an image processor 111 and a timing controller 112.

The image processor 111 applies various types of image processing to a video signal Vdisp. The image processing applied by the image processor 111 includes, for example, gamma conversion or the like. In the present embodiment, the image processing includes at least luminance adjustment processing of the video signal Vdisp. The luminance adjustment processing according to the present embodiment will be described later. The present disclosure is not limited by image processing other than the luminance adjustment processing applied by the image processor 111.

The timing controller 112 generates the control signals including a first timing pulse LP1, a second timing pulse LP2, a third timing pulse LP3, an initialization voltage output timing control signal xasw1, a video voltage output timing control signal xasw2, a light emission control signal BG, and a reset control signal RG based on the video signal Vdisp.

The video signal driver 100 generates video voltages VsigR, VsigG, and VsigB based on the video signal Vdisp received from the controller 11.

The video signal driver 100 includes initialization signal control switches 101, 103, and 105 and video voltage control switches 102, 104, and 106.

The initialization signal control switch 101 is coupled, at one of the source and the drain (first terminal) thereof, to the video signal line 110, and is supplied, at the other thereof (second terminal), with an initialization voltage Vini. The gate (third terminal) of the initialization signal control switch 101 receives the initialization voltage output timing control signal xasw1.

The initialization signal control switch 103 is coupled, at one of the source and the drain (first terminal) thereof, to the video signal line 120, and is supplied, at the other thereof (second terminal), with the initialization voltage Vini. The gate (third terminal) of the initialization signal control switch 103 receives the initialization voltage output timing control signal xasw1.

The initialization signal control switch 105 is coupled, at one of the source and the drain (first terminal) thereof, to the video signal line 130, and is supplied, at the other thereof (second terminal), with the initialization voltage Vini. The gate (third terminal) of the initialization signal control switch 105 receives the initialization voltage output timing control signal xasw1.

In the present embodiment, each of the initialization signal control switches 101, 103, and 105 is, for example, a transistor. When the initialization voltage output timing control signal xasw1 is applied to the gates of the initialization signal control switches 101, 103, and 105, the initialization signal control switches 101, 103, and 105 are brought into the conductive state, and the initialization voltage Vini is applied to the video signal lines 110, 120, and 130.

The video voltage control switch 102 is coupled, at one of the source and the drain (first terminal) thereof, to the video signal line 110, and is supplied, at the other thereof (second terminal), with the video voltage VsigR. The gate (third terminal) of the video voltage control switch 102 receives the video voltage output timing control signal xasw2.

The video voltage control switch 104 is coupled, at one of the source and the drain (first terminal) thereof, to the video signal line 120, and is supplied, at the other thereof (second terminal), with the video voltage VsigG. The gate (third terminal) of the video voltage control switch 104 receives the video voltage output timing control signal xasw2.

The video voltage control switch 106 is coupled, at one of the source and the drain (first terminal) thereof, to the video signal line 130, and is supplied, at the other thereof (second terminal), with the video voltage VsigB. The gate (third terminal) of the video voltage control switch 106 receives the video voltage output timing control signal xasw2.

In the present embodiment, each of the video voltage control switches 102, 104, and 106 is, for example, a transistor. When the video voltage output timing control signal xasw2 is applied to the gate of the video voltage control switch 102, the video voltage control switch 102 is brought into the conductive state, and the video voltage VsigR is applied to the video signal line 110. When the video voltage output timing control signal xasw2 is applied to the gate of the video voltage control switch 104, the video voltage control switch 104 is brought into the conductive state, and the video voltage VsigG is applied to the video signal line 120. When the video voltage output timing control signal xasw2 is applied to the gate of the video voltage control switch 106, the video voltage control switch 106 is brought into the conductive state, and the video voltage VsigB is applied to the video signal line 130. In the present embodiment, the video voltages VsigR, VsigG, and VsigB are gradation signals corresponding to the video signal Vdisp.

The scan signal driver 200 includes a reset control switch 235.

The reset control switch 235 is coupled, at one of the source and the drain (first terminal) thereof, to the power supply line 230, and is supplied, at the other thereof (second terminal), with a reset voltage Vrst. The gate (third terminal) of the reset control switch 235 receives the reset control signal RG. In the present embodiment, the reset control switch 235 is, for example, a transistor. When the reset control signal RG is applied to the gate of the reset control switch 235, the reset control switch 235 is brought into the conductive state, and the reset voltage Vrst is applied to the power supply line 230.

The pixel Pix includes the sub-pixels Rpix, Gpix, and Bpix and the light emission control switch 31.

The light emission control switch 31 is coupled, at one of the source and the drain (first terminal) thereof, to corresponding one of the high-potential supply lines 310. The gate (third terminal) of the light emission control switch 31 is coupled to the light emission control line 220. In the present embodiment, the light emission control switch 31 is, for example, a TFT element.

The sub-pixel Rpix includes a pixel switch 331, a drive transistor 341, an organic light-emitting diode 371, a storage capacitor 351, and an additional capacitor 361.

The pixel switch 331 is coupled, at one of the source and the drain (first terminal) thereof, to the video signal line 110. The gate (third terminal) of the pixel switch 331 is coupled to the scan signal line 210. In the present embodiment, the pixel switch 331 is, for example, a TFT element.

The drive transistor 341 is coupled, at one of the source and the drain (first terminal) thereof, to the anode of the organic light-emitting diode 371, and is coupled, at the other thereof (second terminal), to the power supply line 230 and the other of the source and the drain (second terminal) of the light emission control switch 31. The gate (third terminal) of the drive transistor 341 is coupled to the other of the source and the drain (second terminal) of the pixel switch 331. In the present embodiment, the drive transistor 341 is, for example, an n-channel transistor. However, a p-channel transistor can be used according to circuit configuration.

In the present embodiment, the storage capacitor 351 is coupled between the source and the gate (third terminal) of the drive transistor 341. In the present embodiment, the additional capacitor 361 is coupled between the source of the drive transistor 341 and corresponding one of the low-potential supply lines 320, corresponding one of the high-potential supply lines 310, or a predetermined reference voltage. In the present embodiment, the additional capacitor 361 may be provided between the source of the drive transistor 341 and the low-potential supply line 320, and between the source (first terminal) of the drive transistor 341 and the high-potential supply line 310. However, one terminal of the additional capacitor 361 can be coupled to the drain of the driver transistor 341 instead of the source, according to circuit configuration.

When a scan voltage SG is applied from the scan signal driver 200 to the scan signal line 210, the pixel switch 331 is brought into the conductive state. In the case where the pixel switch 331 is in the conductive state, when the video voltage VsigR is applied from the video signal driver 100 to the video signal line 110, the video voltage VsigR is applied to the gate (third terminal) of the drive transistor 341.

The drive transistor 341 controls the current value supplied to the organic light-emitting diode 371 according to the voltage between the gate and the source of the drive transistor 341.

When the voltage is applied to the gate (third terminal) of the drive transistor 341, an electric charge is stored in the storage capacitor 351. After the electric charge for delivering a predetermined current to the drive transistor 341 is stored in the storage capacitor 351, the pixel switch 331 is brought into the non-conductive state to maintain the voltage between the gate and the source of the drive transistor 341. A current corresponding to the voltage between the gate and the source of the drive transistor 341 flows therein. The current between the drain and the source of the drive transistor 341 flows in the organic light-emitting diode 371, and the organic light-emitting diode 371 emits light at luminance corresponding to the current value.

The additional capacitor 361 coupled to the source of the drive transistor 341 has a role of setting the voltage between the gate (third terminal) and the source of the drive transistor 341 according to the voltage level of the video voltage VsigR through capacitance division with the storage capacitor 351. Specifically, the capacitance of the additional capacitor 361 is often set to be larger than the capacitance of the storage capacitor 351 to increase the setting range of the voltage between the gate (third terminal) and the source (first terminal) of the drive transistor 341.

The cathode of the organic light-emitting diode 371 is coupled to the low-potential supply line 320. In the case where the drive transistor 341 is in the conductive state, after the light emission control switch 31 is brought into the conductive state, a current corresponding to the voltage between the gate and the source of the drive transistor 341 flows in the organic light-emitting diode 371, and the organic light-emitting diode 371 emits light.

The sub-pixel Gpix includes a pixel switch 332, a drive transistor 342, an organic light-emitting diode 372, a storage capacitor 352, and an additional capacitor 362.

The pixel switch 332 is coupled, at one of the source and the drain (first terminal) thereof, to the video signal line 120. The gate (third terminal) of the pixel switch 332 is coupled to the scan signal line 210. In the present embodiment, the pixel switch 332 is, for example, a TFT element.

The drive transistor 342 is coupled, at one of the source and the drain (first terminal) thereof, to the anode of the organic light-emitting diode 372, and is coupled, at the other thereof (second terminal), to the power supply line 230 and the other of the source and the drain (second terminal) of the light emission control switch 31. The gate (third terminal) of the drive transistor 342 is coupled to the other of the source and the drain (second terminal) of the pixel switch 332. In the present embodiment, the drive transistor 342 is, for example, an n-channel transistor. However a p-channel transistor can be used according to circuit configuration.

In the present embodiment, the storage capacitor 352 is coupled between the source and the gate (third terminal) of the drive transistor 342. In the present embodiment, an additional capacitor 362 is coupled between the source and the low-potential supply line 320, the high-potential supply line 310, or the predetermined reference voltage. In the present embodiment, the additional capacitor 362 may be provided between the source of the drive transistor 342 and the low-potential supply line 320, and between the source of the drive transistor 342 and the high-potential supply line 310. However, one terminal of the additional capacitor 362 can be coupled to the drain of the driver transistor 342 instead of the source, according to circuit configuration.

When the scan voltage SG is applied from the scan signal driver 200 to the scan signal line 210, the pixel switch 332 is brought into the conductive state. In the case where the pixel switch 332 is in the conductive state, when the video voltage VsigG is applied from the video signal driver 100 to the video signal line 120, the video voltage VsigG is applied to the gate (third terminal) of the drive transistor 342.

The drive transistor 342 controls the current value supplied to the organic light-emitting diode 372 according to the voltage between the gate and the source of the drive transistor 342.

When the voltage is applied to the gate (third terminal) of the drive transistor 342, an electric charge is stored in the storage capacitor 352. After the electric charge for delivering a predetermined current to the drive transistor 342 is stored in the storage capacitor 352, the pixel switch 332 is brought into a non-conduction state to maintain the voltage between the gate and the source of the drive transistor 342. A current corresponding to the voltage between the gate and the source of the drive transistor 342 flows therein. The current between the drain and the source of the drive transistor 342 flows in the organic light-emitting diode 372, and the organic light-emitting diode 372 emits light at luminance corresponding to the current value.

In the present embodiment, the additional capacitor 362 coupled to the source of the drive transistor 342 has a role of setting the voltage between the gate (third terminal) and the source of the drive transistor 342 according to the voltage level of the video voltage VsigG through capacitance division with the storage capacitor 352. However, one terminal of the additional capacitor 361 can be coupled to the drain of the driver transistor 341 instead of the source, according to circuit configuration. Specifically, the capacitance of the additional capacitor 362 is often set to be larger than the capacitance of the storage capacitor 352 to increase the setting range of the voltage between the gate (third terminal) and the source of the drive transistor 342.

The cathode of the organic light-emitting diode 372 is coupled to the low-potential supply line 320. In the case where the drive transistor 342 is in the conductive state, after the light emission control switch 31 is brought into the conductive state, a current corresponding to the voltage between the gate and the source of the drive transistor 342 flows in the organic light-emitting diode 372, and the organic light-emitting diode 372 emits light.

The sub-pixel Bpix includes a pixel switch 333, a drive transistor 343, an organic light-emitting diode 373, a storage capacitor 353, and the additional capacitor 363.

The pixel switch 333 is coupled, at one of the source and the drain (first terminal) thereof, to the video signal line 130. The gate (third terminal) of the pixel switch 333 is coupled to the scan signal line 210. In the present embodiment, the pixel switch 333 is, for example, a TFT element.

The drive transistor 343 is coupled, at one of the source and the drain (first terminal) thereof, to the anode of the organic light-emitting diode 373, and is coupled, at the other thereof (second terminal), to the power supply line 230 and the other of the source and the drain (second terminal) of the light emission control switch 31. The gate (third terminal) of the drive transistor 343 is coupled to the other of the source and the drain (second terminal) of the pixel switch 333. In the present embodiment, the drive transistor 343 is, for example, an n-channel transistor. However, a p-channel transistor can be used according to circuit configuration.

In the present embodiment, the storage capacitor 353 is coupled between the source and the gate (third terminal) of the drive transistor 343. In the present embodiment, the additional capacitor 363 is coupled between the source of the drive transistor 343 and the low-potential supply line 320, the high-potential supply line 310, or the predetermined reference voltage. In the present embodiment, the additional capacitor 363 may be provided both between the source of the drive transistor 343 and the low-potential supply line 320, and between one of the source and the drain (first terminal) of the drive transistor 343 and the high-potential supply line 310. However, one terminal of the additional capacitor 363 can be coupled to the drain of the driver transistor 343 instead of the source, according to circuit configuration.

When the scan voltage SG is applied from the scan signal driver 200 to the scan signal line 210, the pixel switch 333 is brought into the conductive state. In the case where the pixel switch 333 is in the conductive state, when the video voltage VsigB is applied from the video signal driver 100 to the video signal line 130, the video voltage VsigB is applied to the gate (third terminal) of the drive transistor 343.

The drive transistor 343 controls the current value supplied to the organic light-emitting diode 373 according to the voltage between the gate and the source of the drive transistor 343.

When the voltage is applied to the gate (third terminal) of the drive transistor 343, an electric charge is stored in the storage capacitor 353. After the electric charge for delivering a predetermined current to the drive transistor 343 is stored in the storage capacitor 353, the pixel switch 333 is brought into a non-conduction state to maintain the voltage between the gate and the source of the drive transistor 343. A current corresponding to the voltage between the gate and the source of the drive transistor 343 flows therein. The current between the drain and the source of the drive transistor 343 flows in the organic light-emitting diode 373, and the organic light-emitting diode 373 emits light at luminance corresponding to the current value.

The additional capacitor 363 coupled to the source of the drive transistor 343 has a role of setting the voltage between the gate (third terminal) and the source of the drive transistor 343 according to the voltage level of the video voltage VsigB through capacitance division with the storage capacitor 353. Specifically, the capacitance of the additional capacitor 363 is often set to be larger than the capacitance of the storage capacitor 353 to increase the setting range of the voltage between the gate (third terminal) and the source of the drive transistor 343.

The cathode of the organic light-emitting diode 373 is coupled to the low-potential supply line 320. In the case where the drive transistor 343 is in the conductive state, after the light emission control switch 31 is brought into the conductive state, a current corresponding to the voltage between the gate and the source of the drive transistor 343 flows in the organic light-emitting diode 373, and the organic light-emitting diode 373 emits light.

The light emission control switch 31 controls electrical couplings between the others of the sources and the drains (second terminals) of the drive transistors 341, 342, and 343 and the high-potential supply line 310. In the present embodiment, the light emission control switch 31 is, for example, an n-channel transistor. A p-channel transistor can be used as the light emission control switch instead of n-channel transistor. The gate (third terminal) of the light emission control switch 31 is coupled to the light emission control line 220. When the light emission control signal BG is applied from the scan signal driver 200 to the light emission control line 220, the light emission control switch 31 is brought into the conductive state.

When the light emission control switch 31 is in the non-conductive state and the reset control switch 235 is in the conductive state, the others of the sources and the drains (second terminals) of the drive transistors 341, 342, and 343 are coupled to the power supply line 230. The reset voltage Vrst is set to a voltage at which no current flows in the organic light-emitting diodes 371, 372, and 373 during a reset condition, and may be set to, for example, the potential of the low-potential supply line 320.

The equivalent circuit diagram illustrated in FIG. 2 is merely an example. A different circuit may be employed. For example, the light emission control switch 31 may be provided in each of the three sub-pixels Rpix, Gpix, and Bpix.

Regarding the initialization signal control switches 101, 103, and 105, the video voltage control switches 102, 104, and 106, the reset control switch 235, the pixel switches 331, 332, and 333, the drive transistors 341, 342, and 343, and the light emission control switch 31 described above, which of the source and the drain serves as the first terminal or the second terminal is appropriately selected according to the circuit configurations of the video signal driver 100, the scan signal driver 200, and the sub-pixels Rpix, Gpix, and Bpix.

Figure 3:
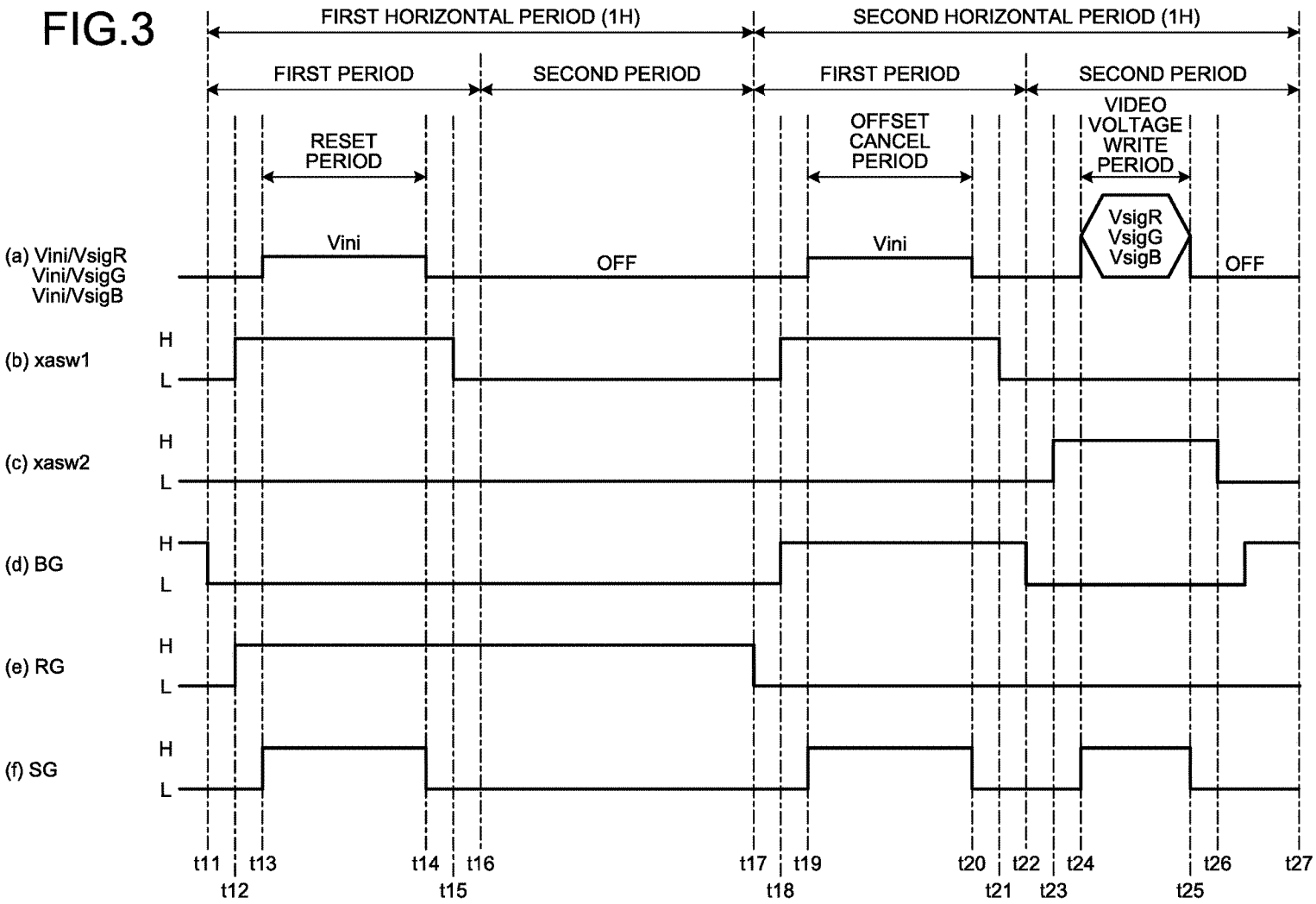
FIG. 3 is a timing diagram for control signals in the display device according to the embodiment.

The following describes a detailed operation of the display device 1 according to the present embodiment. FIG. 3 is a timing diagram for the control signals in the display device according to the embodiment.

In the timing diagram illustrated in FIG. 3, the horizontal axis represents time. (a) of FIG. 3 illustrates the initialization voltage Vini or the video voltages VsigR, VsigG, and VsigB supplied from the video signal driver 100 to the first video signal line 110. In the example illustrated in (a) of FIG. 3, the vertical axis represents the level of the initialization voltage Vini or the video voltages VsigR, VsigG, and VsigB. FIG. 3 illustrates the timing diagram in the case where the transistors 101, 102, 103, 104, 105, 106, 235, 31, 331, 341, 332, 342, 333, and 343 are n-channel transistors.

(b) of FIG. 3 illustrates the initialization voltage output timing control signal xasw1 supplied from the controller 11 to the video signal driver 100. (c) of FIG. 3 illustrates the video voltage output timing control signal xasw2 supplied from the controller 11 to the video signal driver 100. (d) of FIG. 3 illustrates the light emission control signal BG supplied from the controller 11 to the scan signal driver 200. (e) of FIG. 3 illustrates the reset control signal RG supplied from the controller 11 to the scan signal driver 200. (f) of FIG. 3 illustrates the scan voltage SG supplied from the scan signal driver 200 to the scan signal line 210. In the examples illustrated in (b), (c), (d), (e), and (f) of FIG. 3, the vertical axis represents a logic level "L" or "H" of each of the signals.

The display operation of the display device 1 according to the present embodiment is performed by raster scanning. In the present embodiment, a plurality of pixel rows constituting the display region 20 of the organic EL panel 10 are sequentially selected from the first row, and the video voltages VsigR, VsigG, and VsigB are written to pixels Pix in the selected row to cause the pixels Pix to emit light, and this operation is repeated for each video signal Vdisp of one frame. The write operation in the present embodiment is divided into a reset operation, an offset cancel operation, and a video voltage write operation.

The display device 1 according to the present embodiment performs the reset operation, the offset cancel operation, and the video voltage write operation during two horizontal periods (2H) for each pixel row. In the example illustrated in FIG. 3, one horizontal period (1H) is divided into a first period and a second period. For each pixel row, the reset operation is performed during the first period of earlier one horizontal period (1H) (hereinafter, also called the first horizontal period). Subsequently, the offset cancel operation is performed during the first period of later one horizontal period (1H) (hereinafter, also called the second horizontal period), and the video voltage write operation is performed during the subsequent second period of the second horizontal period.

In the example illustrated in FIG. 3, a period from time t11 to time t17 serves as the first horizontal period, a period from time t11 to time t16 as the first period in the first horizontal period, a period from time t16 to time t17 as the second period in the first horizontal period, a period from time t17 to time t22 as the first period in the second horizontal period, and a period from time t22 to time t27 as the second period in the second horizontal period.

The reset operation will first be described.

The light emission control signal BG is controlled to change from "H" to "L" at time t11 of the first horizontal period, and the logic level of the reset control signal RG is controlled to change from "L" to "H" at the subsequent time t12. Then, the reset control switch 235 is brought into the conductive state, and the reset voltage Vrst is supplied to the power supply line 230, and applied to the others of the sources and the drains (second terminals) of the drive transistors 341, 342, and 343. At this time, the logic level of the initialization voltage output timing control signal xasw1 is controlled to change from "L" to "H" in synchronization with the reset control signal RG. Then, the initialization signal control switches 101, 103, and 105 are brought into the conductive state, and the video signal driver 100 starts loading data of the initialization voltage Vini to supply the initialization voltage Vini to the video signal lines 110, 120, and 130.

At the subsequent time t13, the logic level of the scan voltage SG is controlled to change from "L" to "H". Then, the pixel switches 331, 332, and 333 are brought into the conductive state, and the initialization voltage Vini is applied to the gates (third terminals) of the drive transistors 341, 342, and 343 through the pixel switches 331, 332, and 333.

As a result, the potentials of the gates (third terminals) of the drive transistors 341, 342, and 343 are initialized to a potential corresponding to the initialization voltage Vini. The drive transistors 341, 342, and 343 are brought into the conductive state. Consequently, the potentials of the sources of the drive transistors 341, 342, and 343 are reset to a potential corresponding to the reset voltage Vrst, and the voltages across terminals of the storage capacitors 351, 352, and 353 are set to a voltage corresponding to (Vini-Vrst). A voltage corresponding to (Vrst-Vss) is applied to the organic light-emitting diodes 371, 372, and 373. The reset voltage Vrst is set such that the voltage applied to the organic light-emitting diodes 371, 372, and 373 is equal to or lower than a light emission threshold voltage (light emission start voltage) of the organic light-emitting diodes 371, 372, and 373. For example, the light emission threshold voltage is a voltage at which a current starts flowing in each of the organic light-emitting diodes 371, 372, and 373, that is, a forward voltage drop.

Then, the logic level of the scan voltage SG is controlled to change from "H" to "L" at time t14. Then, the pixel switches 331, 332, and 333 are brought into the non-conductive state, and the reset operation ends. At the subsequent time t15, the logic level of the initialization voltage output timing control signal xasw1 is controlled to change from "H" to "L". Then, the initialization signal control switches 101, 103, and 105 are brought into the non-conductive state, and the video signal driver 100 stops loading the data of the initialization voltage Vini. The period from time t13 to time t14 in the first period of the first horizontal period is hereinafter called a "reset period".

The following describes the offset cancel operation.

The logic level of the reset control signal RG is controlled to change from "H" to "L" at time t17 of the second horizontal period, and the logic level of the light emission control signal BG is controlled to change from "L" to "H" at the subsequent time t18. Then, the light emission control switch 31 is brought into the conductive state, and the high-potential voltage Vdd is supplied to the power supply line 230, and applied to the drains (second terminals) of the drive transistors 341, 342, and 343 in this embodiment. At this time, the logic level of the initialization voltage output timing control signal xasw1 is controlled to change from "L" to "H" in synchronization with the light emission control signal BG. Then, the initialization signal control switches 101, 103, and 105 are brought into the conductive state, and the video signal driver 100 starts loading the data of the initialization voltage Vini to supply the initialization voltage Vini to the video signal lines 110, 120, and 130.

At the subsequent time t19, the logic level of the scan voltage SG is controlled to change from "L" to "H". Then, the pixel switches 331, 332, and 333 are brought into the conductive state, and the initialization voltage Vini is applied to the gates (third terminals) of the drive transistors 341, 342, and 343 through the pixel switches 331, 332, and 333.

As a result, the potentials of the gates (third terminals) of the pixel switches 331, 332, and 333 are fixed to a potential corresponding to the initialization voltage Vini. Since the light emission control switch 31 is in the conductive state, currents flow into the drive transistors 341, 342, and 343 from the high-potential supply line 310, and the potentials of ones of the sources and the drains (first terminals) of the drive transistors 341, 342, and 343 rise from the reset voltage Vrst that has been written in the reset operation. In this embodiment, the potentials of the sources of the drive transistors 341, 342, and 343 reach a potential (Vini-Vth) that is lower by a threshold voltage Vth than the potentials of the gates (third terminals) thereof. Then, the pixel switches 331, 332, and 333 are brought into the non-conductive state by controlling the scan voltage SG from "H" to "L". At this time, the potentials of the sources are fixed to (Vini-Vth) in this embodiment. The voltages across the terminals of the storage capacitors 351, 352, and 353 are set to a voltage corresponding to the threshold voltage Vth. Assuming this state as a reference, voltages corresponding to the video voltages VsigR, VsigG, and VsigB are written to the storage capacitors 351, 352, and 353 in the video voltage write operation to be described later. This operation cancels the influence of a pixel-to-pixel variation in the threshold voltage Vth among the drive transistors 341, 342, and 343 on the currents flowing in the organic light-emitting diodes 371, 372, and 373 during the light-emitting operations.

At time t20, the logic level of the scan voltage SG is controlled to change from "H" to "L". Then, the pixel switches 331, 332, and 333 are brought into the non-conductive state, and the offset cancel operation ends. At the subsequent time t21, the logic level of the initialization voltage output timing control signal xasw1 is controlled to change from "H" to "L". Then, the initialization signal control switches 101, 103, and 105 are brought into the non-conductive state, and the video signal driver 100 stops loading the data of the initialization voltage Vini. The period from time t19 to time t20 in the first period of the second horizontal period is hereinafter called an "offset cancel period". At the subsequent time t22 the logic level of the scan voltage SG is controlled to change from "H" to "L" at the timing of t22 to shunt the high-potential voltage Vdd.

The following describes the video voltage write operation.

The logic level of the reset control signal RG is maintained at "L" and the logic level of the light emission control signal BG is maintained at "L" during a video voltage write period.

At time t23 of the second horizontal period, the logic level of the video voltage output timing control signal xasw2 is controlled to change from "L" to "H". Then, the video voltage control switches 102, 104, and 106 are brought into the conductive state to supply the video voltage VsigR to the video signal line 110, the video voltage VsigG to the video signal line 120, and the video voltage VsigB to the video signal line 130. At the subsequent time t24, the logic level of the scan voltage SG is controlled to change from "L" to "H". Then, the pixel switches 331, 332, and 333 are brought into the conductive state. This operation raises the potential of the gate (third terminal) of the drive transistor 341 from the potential corresponding to the initialization voltage Vini to a potential corresponding to the video voltage VsigR, the potential of the gate (third terminal) of the drive transistor 342 from the potential corresponding to the initialization voltage Vini to a potential corresponding to the video voltage VsigG, and the potential of the gate (third terminal) of the drive transistor 343 from the potential corresponding to the initialization voltage Vini to a potential corresponding to the video voltage VsigB.

At time t25, the logic level of the scan voltage SG is controlled to change from "H" to "L". Then, the pixel switches 331, 332, and 333 are brought into the non-conductive state, and the video voltage write operation in the second period of the second horizontal period ends. At the subsequent time t26, the logic level of the video voltage output timing control signal xasw2 is controlled to change from "H" to "L". Then, the video signal driver 100 stops loading the data of the video voltages VsigR, VsigG, and VsigB. The period from time t24 to time t25 in the second period of the second horizontal period is hereinafter called a "video voltage write period". During the video voltage write period, the write operation is performed by writing the video voltage VsigR to the sub-pixel Rpix, the video voltage VsigG to the sub-pixel Gpix, and the video voltage VsigB to the sub-pixel Bpix.

After the video voltage write period described above, the logic level of the light emission control signal BG is controlled to change from "L" to "H" after the time t26. And the organic light-emitting diodes 371, 372, and 373 perform the light-emitting operations.

The display device 1 according to the present embodiment performs the display operation of the video signal Vdisp for one frame by performing the reset operation, the offset cancel operation, and the video voltage write operation described above by sequentially shifting these operations by one horizontal period (1H) for each pixel row.

The following describes the luminance adjustment function in the organic EL panel 10 using the organic electroluminescent (EL) elements as the light-emitting elements.

In the organic EL panel 10 using the organic electroluminescent (EL) elements as the light-emitting elements, the power consumption increases with increase in luminance of the image displayed in the display region 20. In particular, in some cases of performing white raster display in which the sub-pixels Rpix, Gpix, and Bpix of all the pixels are lit up, complementary color raster display of yellow (Y) in which the sub-pixels Rpix and Gpix of all the pixels are lit up, the complementary color raster display of magenta (M) in which the sub-pixels Rpix and Bpix of all the pixels are lit up, or the complementary color raster display of cyan (C) in which the sub-pixels Gpix and Bpix of all the pixels are lit up, power may exceed a maximum allowable power that is allowed when the organic EL panel 10 performs the image display. Hence, in the present embodiment, to satisfy the maximum allowable power of the organic EL panel 10, the luminance adjustment function in accordance with the video signal is provided.

Figure 4:
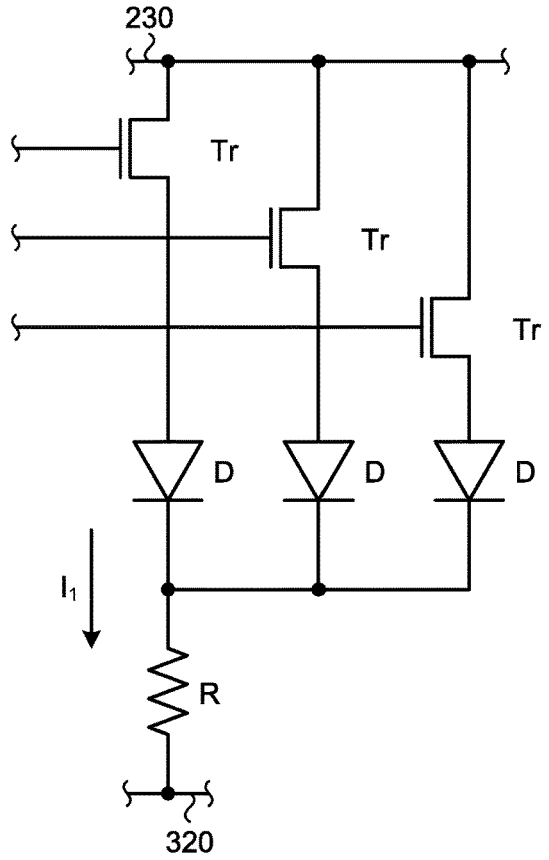
FIG. 4 is a diagram illustrating an equivalent circuit of each pixel of the organic EL panel.

FIG. 4 is a diagram illustrating an equivalent circuit of each pixel of the organic EL panel. In the example illustrated in FIG. 4, Tr denotes each of the drive transistors of the sub-pixels Rpix, Gpix, and Bpix constituting the pixel; D denotes the organic light-emitting diode; and R denotes a parasitic resistance value of the low-potential supply line 320 coupled to the sub-pixels Rpix, Gpix, and Bpix. FIG. 4 assumes a case where the three sub-pixels Rpix, Gpix, and Bpix are simultaneously supplied with video voltages having the same gradation.

Figure 5:
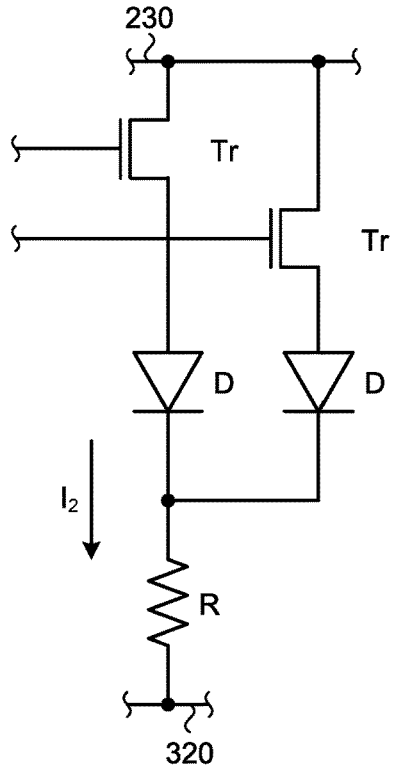
FIG. 5 is a diagram illustrating an equivalent circuit in a case where two sub-pixels in the equivalent circuit illustrated in FIG. 4 are simultaneously supplied with video signals having the same gradation as that of FIG. 4.

FIG. 5 is a diagram illustrating an equivalent circuit in a case where two of the sub-pixels in the equivalent circuit illustrated in FIG. 4 are simultaneously supplied with video signals having the same gradation as that of FIG. 4. FIG. 5 assumes a case where two of the three sub-pixels Rpix, Gpix, and Bpix are simultaneously supplied with video voltages having the same gradation as that of FIG. 4.

Figure 6:
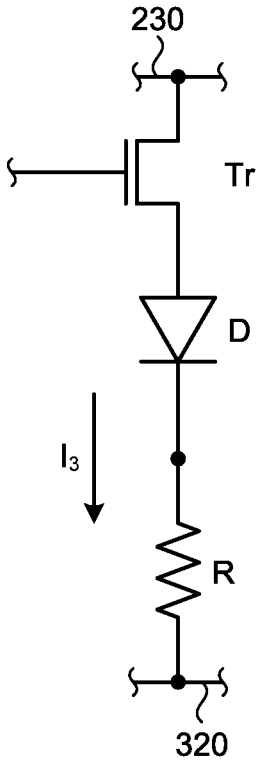
FIG. 6 is a diagram illustrating an equivalent circuit in a case where one sub-pixel in the equivalent circuit illustrated in FIG. 4 is supplied with a video signal having the same gradation as that of FIG. 4.

FIG. 6 is a diagram illustrating an equivalent circuit in a case where one of the sub-pixels in the equivalent circuit illustrated in FIG. 4 is supplied with a video signal having the same gradation as that of FIG. 4. FIG. 6 assumes a case where any one of the three sub-pixels Rpix, Gpix, and Bpix is supplied with a video voltage having the same gradation as that of FIGS. 4 and 5.

A current value $I_1$ that flows when the three sub-pixels Rpix, Gpix, and Bpix are simultaneously supplied with the video signals having the same gradation (FIG. 4) is greater than a current value $I_3$ that flows when one of the sub-pixels is supplied with the video signal having the same gradation as that of FIG. 4 (FIG. 6) ($I_1>I_3$). Therefore, when the three sub-pixels Rpix, Gpix, and Bpix are simultaneously supplied with the video signals having the same gradation (FIG. 4), the potential on the cathode side of the organic light-emitting diode D is higher than that when one of the sub-pixels is supplied with the video signal having the same gradation as that of FIG. 4 (FIG. 6). As a result, a relation represented by Expression (1) below holds between the current value $I_1$ that flows when the three sub-pixels Rpix, Gpix, and Bpix are simultaneously supplied with the video signals having the same gradation (FIG. 4) and the total current value $3I_3$ that flows when each of the three sub-pixels Rpix, Gpix, and Bpix is individually supplied with the video signal having the same gradation as that of FIG. 4.

$$I_1<3I_3 \tag{1}$$

When the three sub-pixels Rpix, Gpix, and Bpix are simultaneously supplied with the video signals having the same gradation (FIG. 4), the potential on the cathode side of the organic light-emitting diode D is higher than that when one of the sub-pixels is supplied with the video signal having the same gradation as that of FIG. 4 (FIG. 6). As a result, a relation represented by Expression (2) below holds between a power consumption $P_1$ obtained when the three sub-pixels Rpix, Gpix, and Bpix are simultaneously supplied with the video signals having the same gradation (FIG. 4) and a total power consumption $3P_3$ obtained when each of the three sub-pixels Rpix, Gpix, and Bpix is individually supplied with the video signal having the same gradation as that of FIG. 4.

$$P_1<3P_3 \tag{2}$$

A current value $I_2$ that flows when two of the sub-pixels are simultaneously supplied with the video signals having the same gradation as that of FIG. 4 (FIG. 5) is greater than the current value $I_3$ that flows when one of the sub-pixels is supplied with the video signal having the same gradation as that of FIG. 4 (FIG. 6) ($I_2>I_3$). Therefore, when two of the sub-pixels are simultaneously supplied with the video signals having the same gradation (FIG. 5), the potential on the cathode side of the organic light-emitting diode D is higher than that when one of the sub-pixels is supplied with the video signal having the same gradation as that of FIG. 4 (FIG. 6). As a result, a relation represented by Expression (3) below holds between the current value $I_2$ that flows when two of the sub-pixels are simultaneously supplied with the video signals having the same gradation as that of FIG. 4 (FIG. 5) and the total current value $2I_3$ that flows when each of the two of the sub-pixels are individually supplied with the video signal having the same gradation as that of FIG. 4.

$$I_2<2I_3 \tag{3}$$

When two of the sub-pixels are simultaneously supplied with the video signals having the same gradation as that of FIG. 4 (FIG. 5), the potential on the cathode side of the organic light-emitting diode D is higher than that when one of the sub-pixels is supplied with the video signal having the same gradation as that of FIG. 4 (FIG. 6). As a result, a relation represented by Expression (4) below holds between a power consumption $P_2$ obtained when two of the sub-pixels are simultaneously supplied with the video signals having the same gradation as that of FIG. 4 (FIG. 5) and the total power consumption $2P_3$ obtained when each of the two of the sub-pixels are individually supplied with the video signal having the same gradation as that of FIG. 4.

$$P_2<2P_3 \tag{4}$$

That is, when a plurality of sub-pixels are simultaneously supplied with video signals, the power consumption is smaller than the total power consumption obtained when each of the sub-pixels is individually supplied with one of the video signals. During the white raster display, a current flows from a plurality of pixels each including the three sub-pixels Rpix, Gpix, and Bpix into the parasitic resistance of the low-potential supply line 320. The following describes a specific example of the luminance adjustment during the white raster display.

Figure 7:
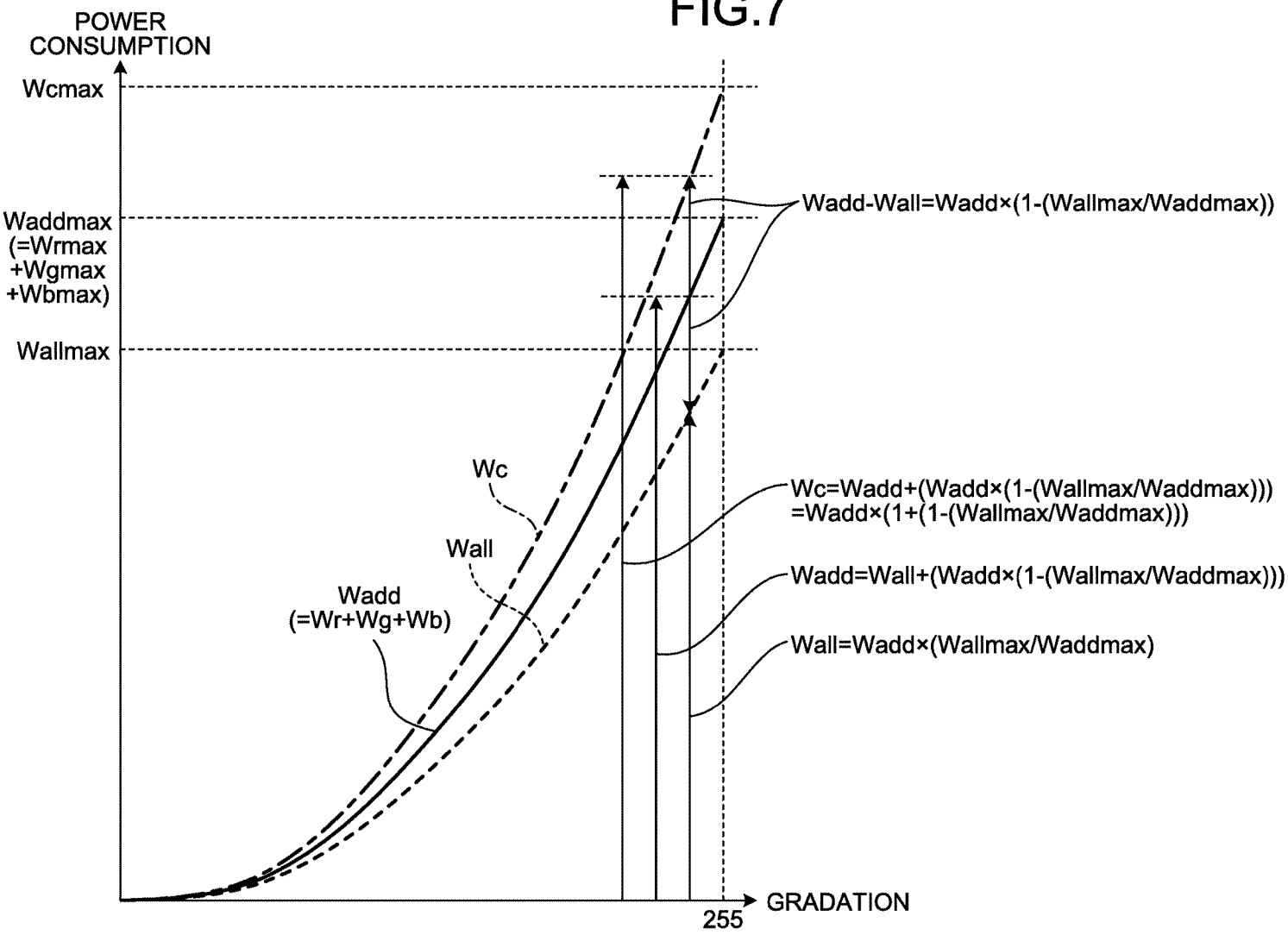
FIG. 7 is a diagram illustrating relations between a display gradation and power consumption during white raster display.

FIG. 7 is a diagram illustrating relations between the display gradation and the power consumption during the white raster display. In FIG. 7, the horizontal axis represents the display gradation and the vertical axis represents the power consumption during the white raster display. The dashed line drawn in FIG. 7 represents a power consumption Wall during the white raster display. The solid line drawn in FIG. 7 represents a first power Wadd obtained by summing a power Wr, a power Wg, and a power Wb required for displaying single-color rasters (R raster, G raster, and B raster) having the same gradation as the display gradation in the white raster display, as given by Expression (5) below. The long dashed short dashed line drawn in FIG. 7 represents a second power We serving as a power consumption value calculated on the preliminary assumption that the actual power consumption decreases therefrom. FIG. 7 illustrates an example in which the display is performed at a maximum of 255 gradation levels.

$$W\text{add}=Wr+Wg+Wb \tag{5}$$

As illustrated in FIG. 7, the ratio (Wall/Wadd) between the power consumption Wall during the white raster display and the first power Wadd obtained by summing the power Wr, the power Wg, and the power Wb required for displaying the single-color rasters having the same gradation as the display gradation in the white raster display is proportional at each of the gradation levels. In other words, a ratio (Wallmax/Waddmax) between a maximum power consumption value Wallmax during the white raster display at the maximum gradation level and a maximum total power consumption value Waddmax obtained by summing a maximum power value Wrmax of the power Wr, a maximum power value Wgmax of the power Wg, and a maximum power value Wbmax of the power Wb required for displaying the single-color rasters having the same gradation as the display gradation in the white raster display at the maximum gradation level is applied as a constant value to all the gradation levels. In this case, the power consumption value Wall during the white raster display is represented by Expression (6) below.

$$W\text{all}=W\text{add}\times(W\text{allmax}/W\text{addmax}) \tag{6}$$

That is, Expression (7) below represents a difference between the power consumption Wall during the white raster display and the first power Wadd obtained by summing the power Wr, the power Wg, and the power Wb required for displaying the single-color rasters having the same gradation as the display gradation in the white raster display.

$$\begin{aligned} Wadd - Wall &= Wadd - Wadd \times (Wallmax/Waddmax) \\ &= Wadd \times (1 - (Wallmax/Waddmax)) \end{aligned} \tag{7}$$

That is, to make the actual power consumption substantially equal to the first power Wadd obtained by summing the power Wr, the power Wg, and the power Wb required for displaying the single-color rasters having the same gradation as the display gradation in the white raster display, a value corresponding to the difference represented by Expression (7) needs to be added to the value of the video signal to be supplied to the organic EL panel 10. That is, the video signal needs to be controlled such that Expression (8) below gives the second power Wc serving as the power consumption calculated on the preliminary assumption that the actual power consumption decreases therefrom, as illustrated by the long dashed short dashed line in FIG. 7.

$$\begin{aligned} Wc &= Wadd + (Wadd - Wadd \times (Wallmax/Waddmax)) \\ &= Wadd \times (1 + (1 - (Wallmax/Waddmax))) \end{aligned} \tag{8}$$

In the present embodiment, Expression (8) given above is deformed into Expression (9) below. That is, the first power Wadd obtained by summing the power Wr, the power Wg, and the power Wb required for displaying the single-color rasters having the same gradation as the display gradation in the white raster display is multiplied by a coefficient α to obtain the second power Wc serving as the power consumption calculated on the preliminary assumption that the actual power consumption decreases therefrom.

$$Wc=W\text{add}\times\alpha \tag{9}$$

(where $\alpha=1+(1-(\text{Wallmax}/\text{Waddmax}))$)

When Wt denotes the maximum allowable power that is allowed when the organic EL panel 10 performs the image display, the luminance adjustment needs to be performed such that the actual power consumption does not exceed the maximum allowable power Wt. In this case, Expression (10) below represents a threshold power Wth.

$$W\text{th}=Wt\times\alpha \tag{10}$$

In a region where the second power Wc exceeds the threshold power Wth, the power consumption can be reduced to the threshold power Wth or smaller by multiplying the second power Wc by a luminance adjustment gain G represented by Expression (11) below.

$$G = Wth/Wc \quad (11)$$

Figure 8:
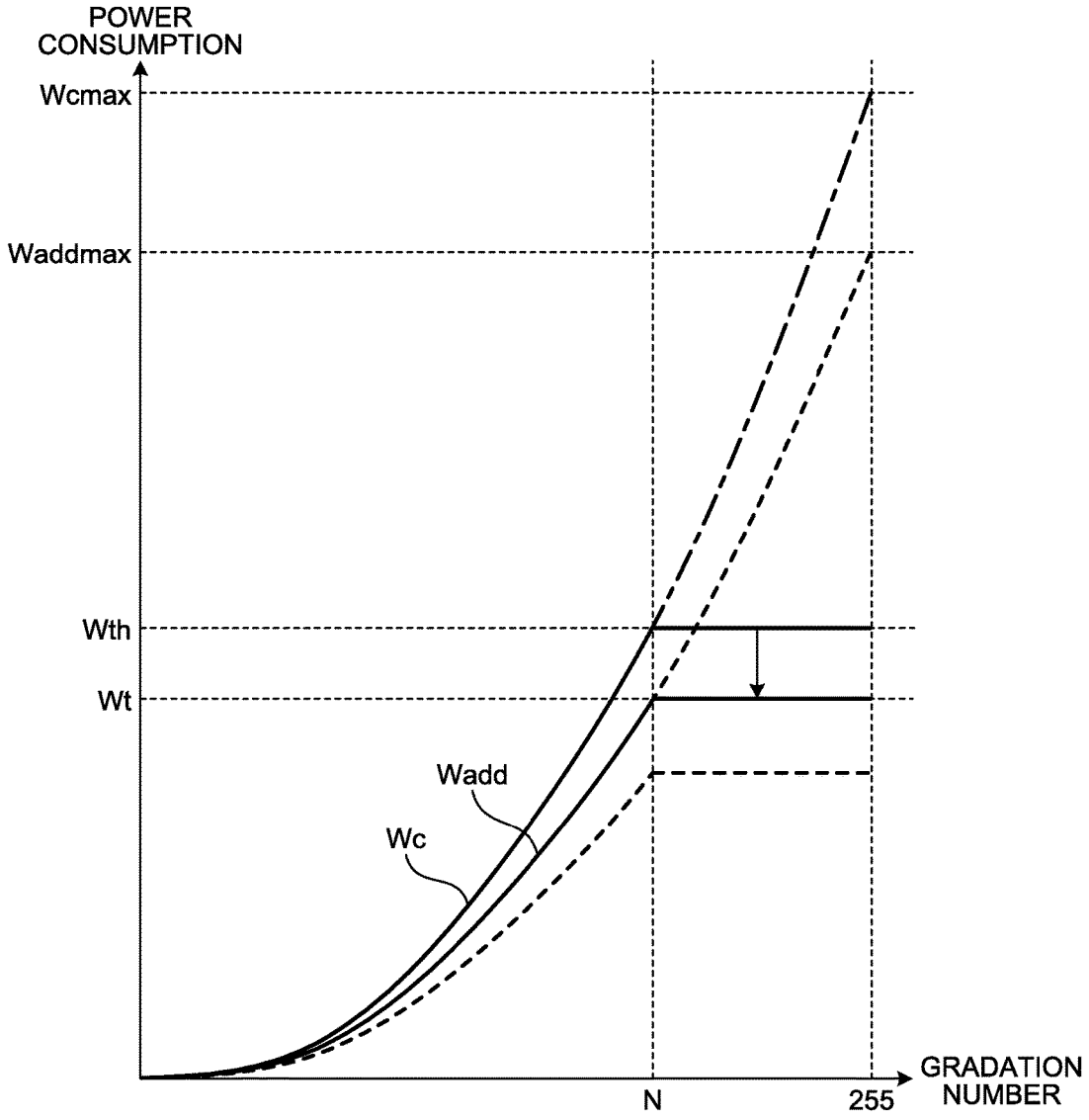
FIG. 8 is a diagram illustrating an exemplary result of luminance adjustment in the case of the white raster display in the display device according to the embodiment.

FIG. 8 is a diagram illustrating an exemplary result of the luminance adjustment in the case of the white raster display in the display device according to the embodiment. In FIG. 8, the horizontal axis represents the display gradation and the vertical axis represents the power consumption during the white raster display.

FIG. 8 illustrates an example in which the second power Wc is equal to the threshold power Wth in a region where the gradation level is equal to or higher than N. According to this example, the actual power consumption is limited to or below the maximum allowable power Wt that is allowed when the organic EL panel 10 performs the image display.

While the above has described the specific example of the luminance adjustment during the white raster display, the same applies in the case where the complementary color raster display is performed, and in the case where a natural image is displayed. That is, in the display operation of the received video signal, the second power Wc is obtained by multiplying the first power Wadd serving as the total value of the power Wr required for displaying red (first color), the power Wg required for displaying green (second color), and the power Wb required for displaying blue (third color) by a predetermined coefficient according to the video signal.

The following describes specific examples of the coefficient α.

For example, in the single-color raster display of red (R), green (G), and blue (B), Expressions (12), (13), and (14) given below hold. In other words, the coefficient is given as α1=1 in the single-color raster display.

$$Wall = Wr \quad (12)$$

$$Wall = Wg \quad (13)$$

$$Wall = Wb \quad (14)$$

For example, in the complementary color raster display of yellow (Y), magenta (M), and cyan (C), the coefficient is denoted as α2, and is equal among these colors.

For example, in the white raster display, the coefficient is denoted as α3.

When the natural image is displayed, the coefficient α can have any value. In the present embodiment, the following describes an example in which a plurality of types of patterns are set in advance, and coefficients α4-1, α4-2, α4-3, . . . , α4-p (where p is a natural number) are set according to each of the patterns. The present disclosure is not limited by the method of setting or method of distinguishing the patterns. The method of determining the coefficient α is not limited to that described above, and the present disclosure is not limited by the method of determining the coefficient α.

Figure 9:
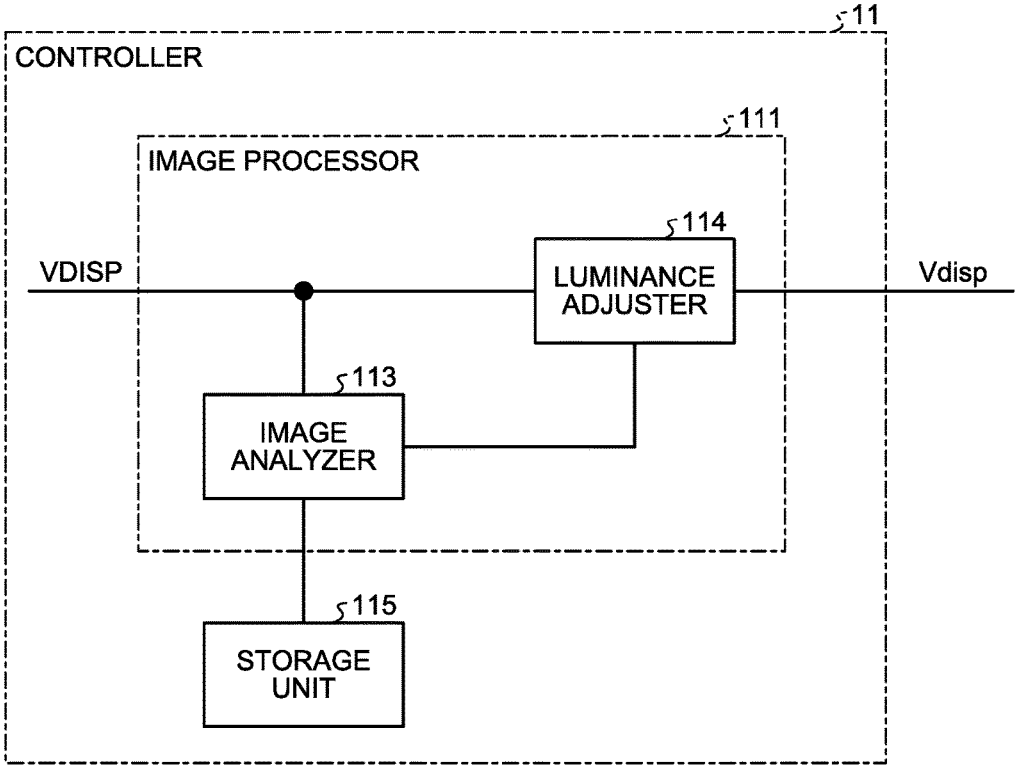
FIG. 9 is a diagram illustrating an exemplary circuit block configuration for performing the luminance adjustment according to the embodiment.

The following describes a specific configuration for performing the above-described luminance adjustment according to the present embodiment. FIG. 9 is a diagram illustrating an exemplary circuit block configuration for performing the luminance adjustment according to the embodiment.

As illustrated in FIG. 9, the image processor 111 of the controller 11 includes an image analyzer 113 and a luminance adjuster 114. The present embodiment is configured to perform the luminance adjustment on the video signal Vdisp after being subjected to the gamma conversion.

The controller 11 includes a storage unit 115 that stores in advance various parameters to be used in the luminance adjustment by the image processor 111.

FIG. 10 is a diagram illustrating an example of coefficient information including the coefficients for the respective patterns of the video signal. FIG. 10 illustrates the example, as coefficient information D1, in which a coefficient when the video signal is a signal to display a red raster (single-color raster (R)), a coefficient when the video signal is a signal to display a green raster (single-color raster (G)), and a coefficient when the video signal is a signal to display a blue raster (single-color raster (B)) are stored each as the coefficient α1 (=1) in the storage unit 115; a coefficient when the video signal is a signal to display a yellow raster (complementary color raster (Y)), a coefficient when the video signal is a signal to display a magenta raster (complementary color raster (M)), and a coefficient when the video signal is a signal to display a cyan raster (complementary color raster (C)) are stored each as the coefficient α2 in the storage unit 115; a coefficient when the video signal is a signal to display a white raster (white raster (W)) is stored as the coefficient α3 in the storage unit 115; and coefficients when the video signals are signals to display natural images (natural image (pattern 1), natural image (pattern 2), natural image (pattern 3), . . . , natural image (pattern p)) of patterns 1, 2, 3, . . . , p (where p is a natural number) are stored as the coefficients α4-1, α4-2, α4-3, . . . , α4-p, respectively, in the storage unit 115. Each of the coefficients may be numerical data, or may be a discrete value, such as digital data.

FIG. 11 is a diagram illustrating an example of maximum power information including the maximum power values for the respective colors each required for displaying the single-color raster at the maximum gradation level. FIG. 11 illustrates the example, as maximum power information D2, in which the maximum power value Wrmax required for displaying the single-color raster (R) at the maximum gradation level, the maximum power value Wgmax required for displaying the single-color raster (G) at the maximum gradation level, and the maximum power value Wbmax required for displaying the single-color raster (B) at the maximum gradation level are stored in the storage unit 115. Each of the maximum power values may be numerical data, or may be a discrete value, such as digital data.

Figure 12:
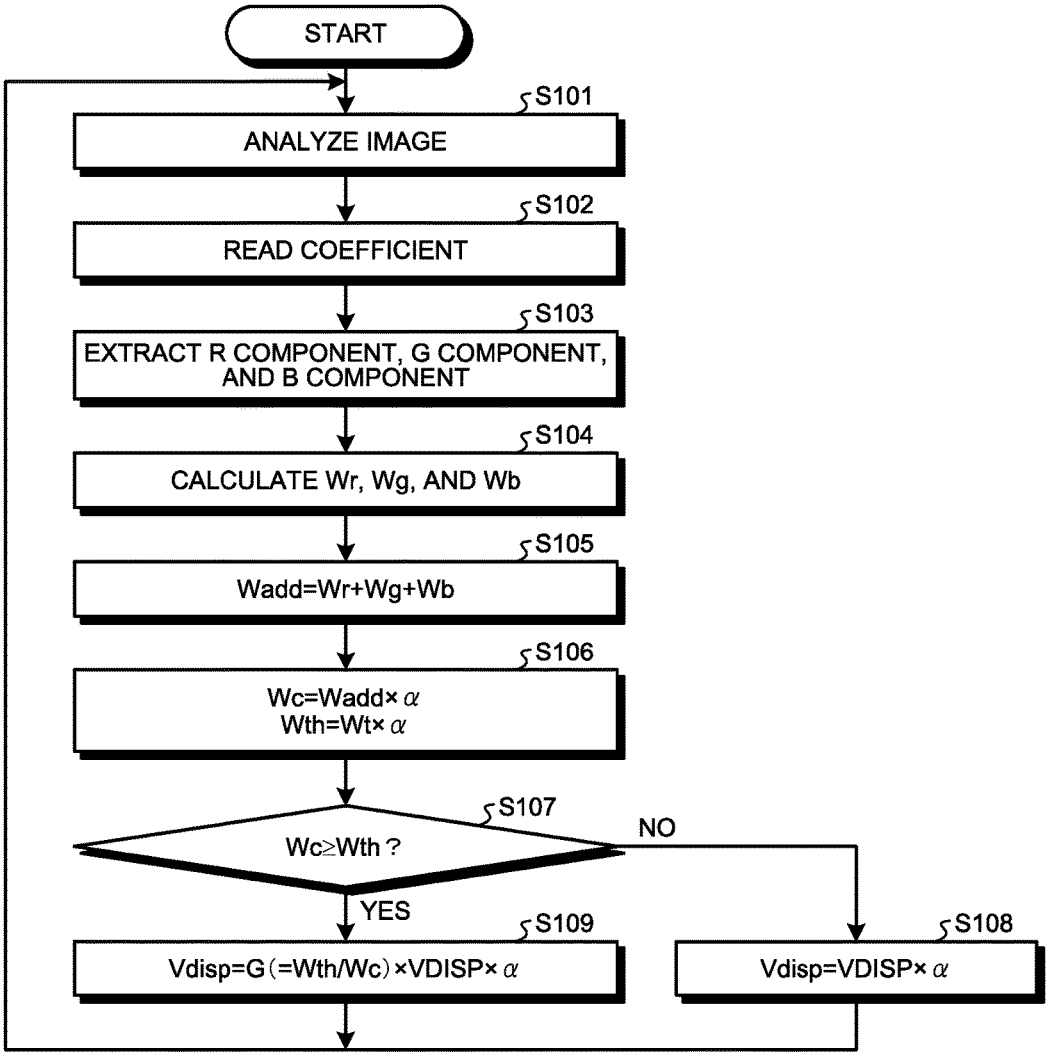
FIG. 12 is a flowchart illustrating an exemplary luminance adjustment procedure according to the embodiment.

FIG. 12 is a flowchart illustrating an exemplary luminance adjustment procedure according to the embodiment. The following describes an operation of the image processor 111 according to the flowchart illustrated in FIG. 12.

The image analyzer 113 first analyzes a received video signal VDISP for one frame (Step S101). Examples of methods of image analysis in the image analyzer 113 include a histogram analysis. The present disclosure is, however, not limited by the method of image analysis in the image analyzer 113.

Based on the result of the image analysis, the image analyzer 113 reads a coefficient according to the video signal VDISP from the storage unit 115 (Step S102).

For example, if the video signal VDISP is a signal indicating to display the single-color raster (R), the single-color raster (G), or the single-color raster (B), the image analyzer 113 reads the coefficient α1 (=1) from the storage unit 115.

For example, if the video signal VDISP is a signal indicating to display the complementary color raster (Y), the complementary color raster (M), or the complementary color raster (C), the image analyzer 113 reads the coefficient α2 from the storage unit 115.

For example, if the video signal VDISP is a signal indicating to display the white raster (W), the image analyzer 113 reads the coefficient α3 from the storage unit 115.

For example, if the video signal VDISP is a signal indicating to display a natural image, the image analyzer 113 determines which of the patterns 1, 2, 3, . . . , p is the most similar to the video signal VDISP, and reads an appropriate one of the coefficients α4-1, α4-2, α4-3, . . . , α4-p according to the most similar one of the patterns 1, 2, 3, . . . , p.

The image analyzer 113 subsequently extracts the red (R) component, the green (G) component, and the blue (B) component included in the video signal VDISP (Step S103). The image analyzer 113 reads the maximum power values Wrmax, Wgmax, and Wbmax from the storage unit 115, and obtains the power Wr required for displaying the red (R) component, the power Wg required for displaying the green (G) component, and the power Wr required for displaying the blue (B) component (Step S104).

The image analyzer 113 calculates the first power Wadd serving as the total of the power Wr, the power Wg, and the power Wb (Step S105). The image analyzer 113 multiplies the calculated first power Wadd by the coefficient read from the storage unit 115 at Step S102 to obtain the second power Wc, and multiplies the maximum allowable power Wt that is allowed when the organic EL panel 10 performs the image display by the coefficient read from the storage unit 115 at Step S102 to obtain the threshold power Wth (Step S106). The image analyzer 113 outputs the second power Wc, the threshold power Wth, and the coefficient to the luminance adjuster 114.

The luminance adjuster 114 includes a frame buffer that holds the video signal VDISP for one frame while the image analyzer 113 performs the processing from Step S101 to Step S106 described above.

The luminance adjuster 114 determines whether the second power Wc received from the image analyzer 113 is equal to or greater than the threshold power Wth (Step S107).

If the second power Wc received from the image analyzer 113 is less than the threshold power Wth (No at Step S107), the luminance adjuster 114 outputs the video signal Vdisp obtained by multiplying the video signal VDISP for one frame by the coefficient (Step S108).

If the second power Wc received from the image analyzer 113 is equal to or greater than the threshold power Wth (Yes at Step S107), the luminance adjuster 114 outputs the video signal Vdisp that is obtained by multiplying the video signal VDISP for one frame by the coefficient and further multiplying the result by the ratio (Wth/Wc) between the threshold power Wth and the second power Wc as the gain G (Step S109).

The processing described above is performed for each frame, and thus, the luminance adjustment can be appropriately performed regardless of the video signal.

In the present embodiment, the example has been illustrated in which the coefficient α1 has the common value of 1 when the single-color raster (R, G, or B) is displayed. The coefficients may, however, be different from one another when the single-color raster (R), the single-color raster (G), or the single-color raster (B) is displayed. The example has also been illustrated in which the coefficient α2 is common when the complementary color raster (Y, M, or C) is displayed. The coefficients may, however, be different from one another when the complementary color raster (Y), the complementary color raster (M), or the complementary color raster (C) is displayed.

As described above, the display device 1 according to the embodiment includes: the organic EL panel 10, or μLED panel, that includes a plurality of first light-emitting elements for emitting red (first color), a plurality of second light-emitting elements for emitting green (second color), and a plurality of third light-emitting elements for emitting blue (third color); the image analyzer 113 that obtains, in the display operation of the received video signal VDISP, the first power Wadd serving as the total of the power Wr required for displaying red (first color), the power Wg required for displaying green (second color), and the power Wb required for displaying blue (third color), and that calculates the second power Wc by multiplying the first power Wadd by the predetermined coefficient according to the video signal DISP and calculates the threshold power Wth by multiplying, by the coefficient, the maximum allowable power Wt that is allowed when the organic EL panel 10 performs the image display; and the luminance adjuster 114 that multiplies the video signal VDISP by the ratio between the threshold power Wth and the second power Wc when the second power Wc is equal to or greater than the threshold power Wth.

With this configuration, the actual power consumption in the organic EL panel 10 can be reduced to or below the maximum allowable power Wt.

The luminance adjuster 114 can prevent the luminance from decreasing in a low-luminance region where the power consumption is equal to or lower than the maximum allowable power Wt by multiplying the video signal VDISP by the coefficient, regardless of the level of the second power Wc.

Specifically, the image analyzer 113 employs the coefficient α3 (first coefficient) if the video signal VDISP is the signal indicating to display the white raster, and employs the coefficient α1 (second coefficient) if the video signal VDISP is the signal indicating to display the single-color raster.

If the video signal VDISP is the signal indicating to display the single-color raster, the image analyzer 113 varies the coefficient α1 (second coefficient) according to the color of the single-color raster.

The image analyzer 113 employs the coefficient α2 (third coefficient) if the video signal VDISP is the signal indicating to display the complementary color raster.

If the video signal VDISP is the signal indicating to display the complementary color raster, the image analyzer 113 varies the coefficient α2 (third coefficient) according to the color of the complementary color raster.

The image analyzer 113 employs one of the coefficients α4-1, α4-2, α4-3, . . . , α4-p (fourth coefficient) if the video signal VDISP is the signal indicating to display the natural image. If the video signal VDISP is the signal indicating to display the natural image, the image analyzer 113 employs different one of the coefficients α4-1, α4-2, α4-3, . . . , α4-p (fourth coefficient) according to corresponding one of the patterns 1, 2, 3, . . . , p of the natural image.

According to the present embodiment, the display device 1 can be provided that can appropriately adjust the luminance regardless of the video signal.

The components of the embodiment described above can be combined as appropriate. Other operational effects accruing from the aspects described in the present embodiment that are obvious from the description herein, or that are appropriately conceivable by those skilled in the art will naturally be understood as accruing from the present disclosure.

What is claimed is:

1. A display device comprising:

an electroluminescent (EL) panel comprising a plurality of first light-emitting elements configured to emit a first color, a plurality of second light-emitting elements configured to emit a second color, and a plurality of third light-emitting elements configured to emit a third color;

an image analyzer configured to obtain, in displaying of a received video signal, a first power serving as a total value of a power required for displaying the first color, a power required for displaying the second color, and a power required for displaying the third color, and configured to calculate a second power by multiplying the first power by a predetermined coefficient according to the video signal, and calculate a threshold power by multiplying, by the coefficient, a maximum allowable power that is allowed when the EL panel performs image display; and a luminance adjuster configured to multiply the video signal by a ratio between the threshold power and the second power when the second power is equal to or greater than the threshold power.

2. The display device according to claim 1, wherein the luminance adjuster is configured to multiply the video signal by the coefficient regardless of the level of the second power.

3. The display device according to claim 1, wherein the image analyzer is configured to set the coefficient to a first coefficient when the video signal is a signal indicating to display a white raster, and to set the coefficient to a second coefficient different from the first coefficient when the video signal is a signal indicating to display a single-color raster.

4. The display device according to claim 3, wherein the image analyzer is configured to vary the second coefficient according to a color of the single-color raster when the video signal is the signal indicating to display the single-color raster.

5. The display device according to claim 1, wherein the image analyzer is configured to set the coefficient to a third coefficient different from the first coefficient and the second coefficient when the video signal is a signal indicating to display a complementary color raster.

6. The display device according to claim 5, wherein the image analyzer is configured to vary the third coefficient according to a color of the complementary color raster when the video signal is the signal indicating to display the complementary color raster.

7. The display device according to claim 1, wherein the image analyzer is configured to set the coefficient to a fourth coefficient different from the first coefficient, the second coefficient, and the third coefficient when the video signal is a signal indicating to display a natural image.

8. The display device according to claim 7, wherein the image analyzer is configured to vary the fourth coefficient according to a pattern of the natural image when the video signal is the signal indicating to display the natural image.

* * * * *